United States Patent [19]

Noble

[11] 3,977,227

[45] Aug. 31, 1976

[54] METHOD OF COLD EXTRUDING DUCTILE CAST IRON TUBE

[76] Inventor: Charles H. Noble, 3541 Brookwood Road, Birmingham, Ala. 35223

[22] Filed: Apr. 3, 1975

[21] Appl. No.: 564,608

Related U.S. Application Data

[63] Continuation-in-part of Ser. No. 445,655, Feb. 25, 1974, abandoned.

[52] U.S. Cl. ..... 72/367; 29/527.5; 29/527.6; 72/253 R; 72/368

[51] Int. Cl.[2] ..... B21D 3/00

[58] Field of Search ..... 72/367, 368, 370, 343, 72/353, 253; 29/1.2, 1.21, 1.3, 527.5, 527.6, 527.7

[56] References Cited

UNITED STATES PATENTS

| | | | |
|---|---|---|---|
| 1,996,181 | 4/1935 | Wait | 29/527.7 X |
| 2,759,257 | 8/1956 | Schlegel | 29/528 |
| 3,445,922 | 5/1969 | Leghorn | 29/527.6 |
| 3,754,429 | 8/1973 | Creuzet | 72/367 X |
| 3,780,555 | 12/1973 | Balthazar | 72/370 X |

OTHER PUBLICATIONS

National Engineering Laboratory–"A Feasibility Study on Cold Extruding of Cast Iron", E. Whitfield, 7/1967, pp. 323–330.

National Engineering Laboratory–"Cold Extrusion of Some Austenitic Cast Irons"–E. Whitfield, 3/1969, pp. 144–153.

*Primary Examiner*—Victor A. DiPalma
*Attorney, Agent, or Firm*—Roylance, Abrams, Berdo & Kaul

[57] ABSTRACT

Annular articles are produced by cold extruding a tubular ductile cast iron piece through a female die to desirably change the shape of at least an axial portion of the piece. The invention is based on the discovery that the nodular carbon content of ductile cast iron, amounting to, e.g., 10–12% by volume, represents voids of no structural strength in the metal and aids in working the metal in the cold, without damage, to that extent required for extrusion. Application of an extrusion load adequate to bring the metal to the yield point results in all of the metal in the die exhibiting plastic flow. Since the metal is in an annular configuration of decreasing diameter during extrusion, it is subjected to large hoop compression forces which cause the carbon modules to flatten and be arranged in planes which, in the case of an article of circular transverse cross section, are substantially radial relative to the extrusion axis. The iron grains are similarly reshaped and oriented. The extruded articles have increased longitudinal tensile strength and hardness, but ductility is restored by heat treatment.

16 Claims, 31 Drawing Figures

METHOD OF COLD EXTRUDING DUCTILE CAST IRON TUBE

This application is a continuation-in-part of application Ser. No. 445,655, filed Feb. 25, 1974, and now abandoned.

This invention relates to the production of annular articles from ductile cast iron by cold extrusion, and articles so produced.

BACKGROUND OF THE INVENTION

Shaped articles have heretofore usually been made from ductile cast iron by casting the desired shape and machining the cast article. In more recent times, it has been proposed to so control the chemical composition of ductile cast iron that, when the casting is made in a chill mold and fully annealed, the cast metal will be workable by rolling, forging or hammering. However, all prior-art methods for producing articles from ductile cast iron have been unduly expensive, save in the case of centrifugally casting pipe, and there has been an increasing need for less expensive methods because of the shortened supply of steel.

OBJECTS OF THE INVENTION

A general object of the invention is to devise a simpler and less expensive method for producing annular articles from ductile cast iron.

Another object is to provide shaped annular articles of ductile cast iron in which the carbon nodules have been flattened and are preferentially arranged radially of the article.

A further object is to provide a method whereby substantially all or only a portion of a tubular piece of ductile cast iron can be converted to a desired final shape without requiring a machining step other than, e.g., to provide screw threads or the like.

SUMMARY OF THE INVENTION

Method embodiments of the invention are carried out by providing a tubular piece of ductile cast iron and cold extruding at least an axial portion of the piece through a tapered female die under an extrusion load adequate to bring the metal being extruded to the compression yield point, the metal then exhibiting full plastic flow in the die. The generally spherical carbon nodules in the ductile cast iron of the initial piece, amounting to on the order of 10–12% of the total volume of the piece, represent voids of little or no structural strength. While moving through the die, the metal is continuously confined in annular fashion by the active surface of the die and is therefore subjected to large hoop compression forces. Those forces tend to distort the grain structure of the iron, with the effective structural voids represented by the carbon nodules allowing the dimensions of the grains to be increased in directions from wall to wall (e.g., radially in the case of an article of circular transverse cross section) and also axially, and to be decreased in directions at right angles to the planes of increasing dimension. Thus, in effect, the grains are flattened and generally disposed in planes parallel to the extrusion axis and normal to the inner and outer surfaces of the article, thus creating similarly oriented strength planes. The carbon nodules are similarly flattened and oriented. Immediately after extrusion, the articles exhibit markedly increased longitudinal tensile strength and hardness and reduced elongation. However, the articles respond readily to heat treatment, so that the tensile strength, hardness and elongation can be readjusted to suit the conditions of use of the finished article. The articles themselves are new products of manufacture, are less costly to manufacture than similar articles of the prior art, and can have greater longitudinal tensile strength and hardness than ductile cast iron. After stress relieving, these values return to levels normally found in ductile cast iron.

In order that the manner in which the foregoing and other objects are attained according to the invention can be understood in detail, particularly advantageous embodiments thereof will be described with reference to the accompanying drawings, which form part of the original disclosure hereof, and wherein:

FIG. 1 is a vertical sectional view illustrating one manner in which the method can be practiced;

FIGS. 2–6 are photomicrographs at 200× (200 times actual size) of a typical tubular piece of ductile cast iron employed in the method, FIG. 2 being viewed toward the outer surface of the tube, FIG. 3 being viewed toward the inner surface of the tube, FIG. 4 being viewed on a transverse section near the outer surface, FIG. 5 being viewed on a transverse section near the inner surface, and FIG. 6 being viewed on an axial section near the inner surface;

FIGS. 2B–6B are photomicrographs at 200× corresponding to those of FIGS. 2–6, respectively, but taken after a second consecutive cold extrusion;

FIGS. 2C–6C are photomicrographs at 200× corresponding to those of FIGS. 2–6, respectively, but taken after a third consecutive cold extrusion;

Figure 12:
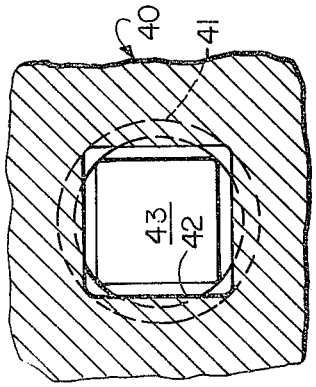
Figure 11:
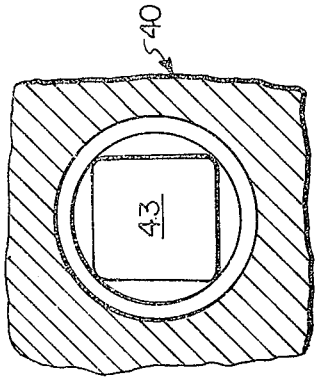
Figure 13:
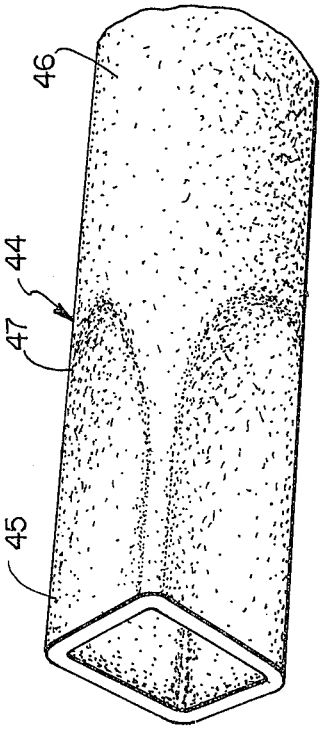
Figure 10:
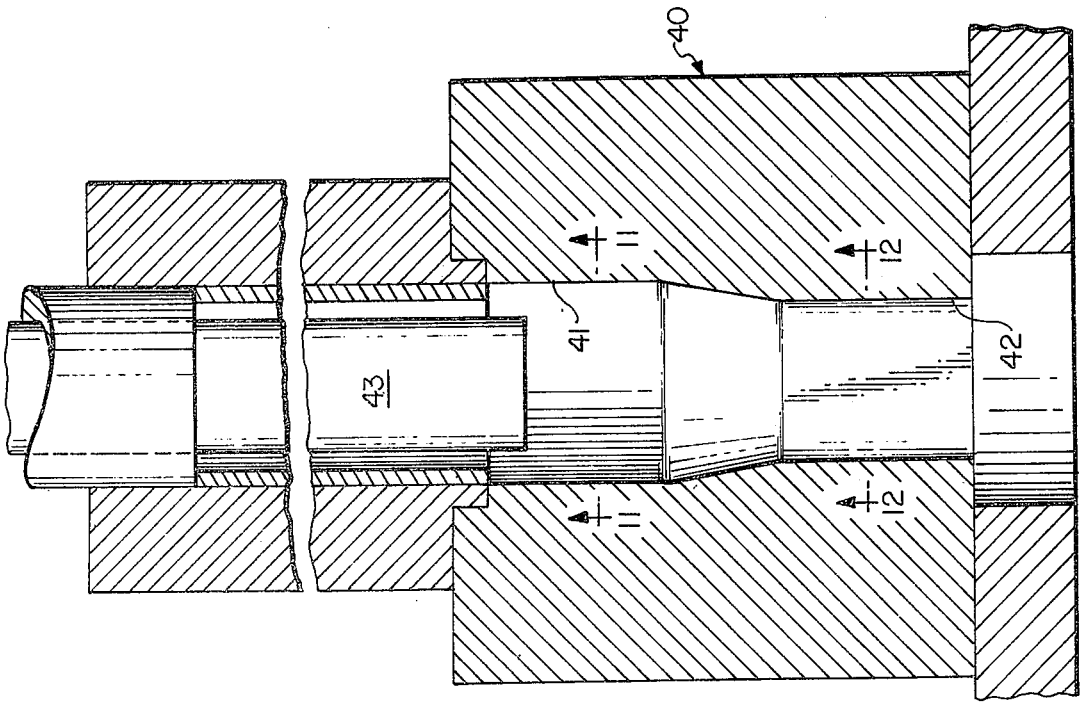
FIG. 10 is a vertical sectional view illustrating another embodiment of the invention.

FIGS. 11 and 12 are transverse sectional views taken generally on lines 11—11 and 12—12, FIG. 10, respectively; and FIG. 13 is a perspective view of the article produced according to FIGS. 10–12.

GENERAL DESCRIPTION OF THE METHOD

Figure 1:
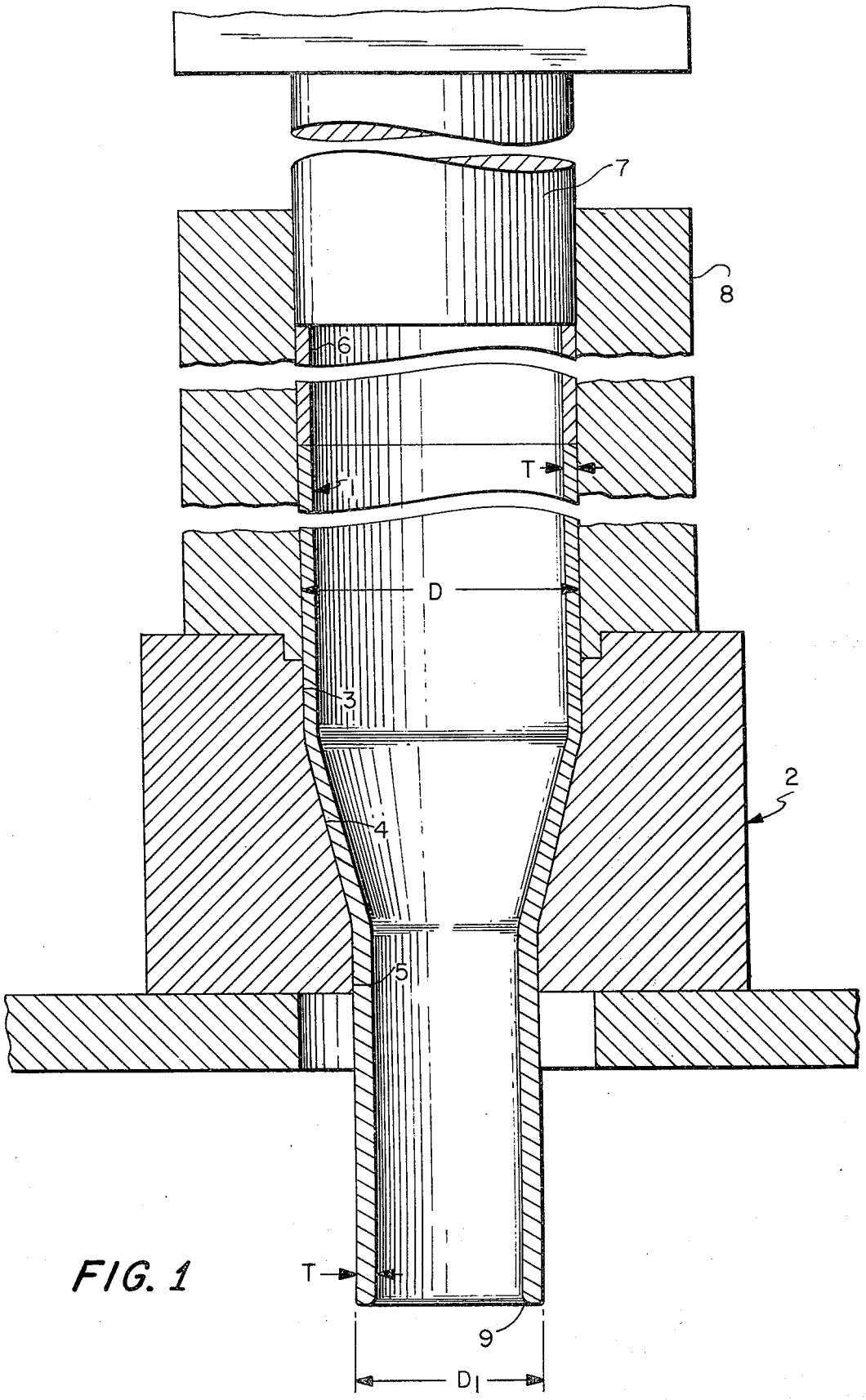
Figure 2:
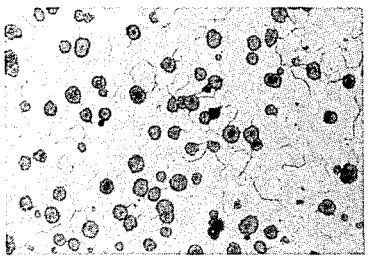
FIGS. 2A–6A are photomicrographs at 200× corresponding to those of FIGS. 2–6, respectively, but taken after a first cold extrusion according to the method.
Figure 2A:
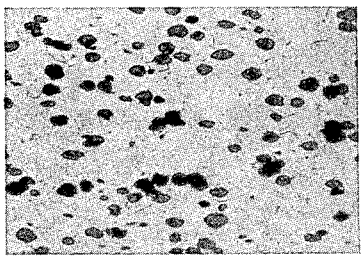
Figure 2B:
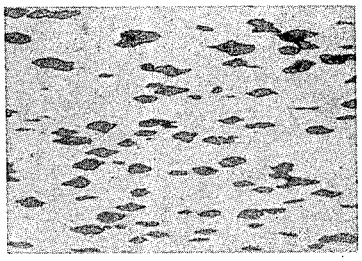
Figure 3:
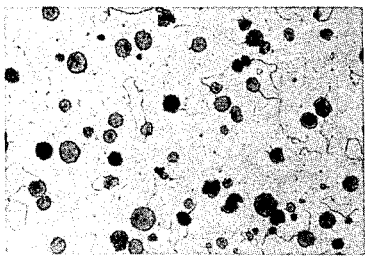
Figure 3A:
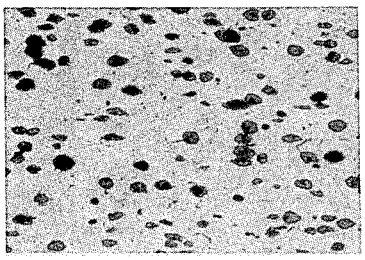
Figure 3B:
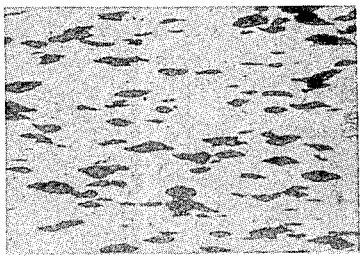

Referring first to FIG. 1, the method is carried out by providing a tubular piece of ductile cast iron 1 and forcing the piece through a female die 2 by applying an axial extrusion pressure such as to cause the ductile cast iron to reach its yield point and traverse the die in a state of plastic flow. The die includes a right cylindrical entrance 3, an active die surface 4 of frustoconical form, and a right cylindrical outlet 5. Tubular piece 1 has an initial outer diameter D and an initial wall thickness T. Extrusion pressure is applied via a follower 6 and a press plunger 7, a guide tube 8 being provided to maintain the tubular workpiece 1 and follower 6 in precise axial alignment with the die orifice.

When plunger 7 has applied an axial pressure to tube 1 to cause the metal thereof which engages die surface 4 to reach the compression yield point, the metal begins to flow through the die, with the outer diameter of the extruded product decreasing to value $D_1$ and the wall thickness increasing to value $T_1$, as shown. While the leading end of the extruded tube is slightly tapered, as indicated at 9, the balance of the product is of uniform wall thickness $T_1$.

Figure 7:
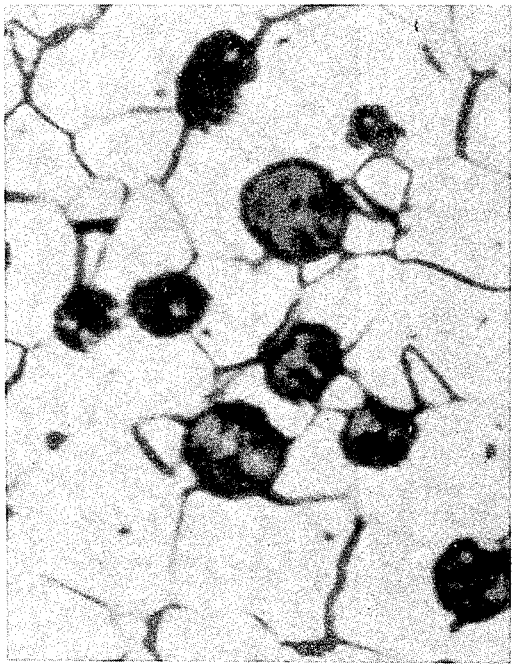
FIG. 7 is a photomicrograph at 800× showing the iron grain structure of a ductile cast iron piece before cold extrusion.
Figure 7A:
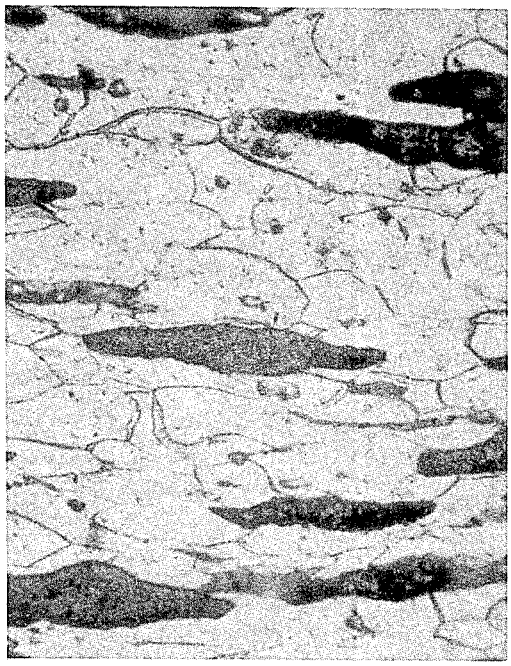
FIG. 7A is a photomicrograph at 800× on a transverse section, near the outer surface, showing the iron grain structure after cold extrusion according to the method.

Prior to extrusion of the tubular piece, the ductile cast iron is characterized by generally spheroidal nodules of carbon distributed in random fashion through the essentially ferritic matrix, as seen in the photomicrographs of FIGS. 2–6, with the nodules representing voids of little or no structural strength equal to, e.g., 10–12% of the volume of the piece. The matrix should be essentially free of iron carbides, and any pearlite content should be minimized, though the method has been successfully practiced with ductile cast iron containing as much as 10% pearlite. Using the die illustrated in FIG. 1, with a die angle of 16°, the tubular piece 1 can be reduced in one extrusion pass from, e.g., an outer diameter of 2.9 in. to an outer diameter of 2.0 in., with an increase in wall thickness from 0.15 in. to 0.2 in. The metal flowing through the die is subjected to large hoop compression forces, so that any increment of the metal being extruded must be viewed as being squeezed circumferentially of the annulus. Under these forces, the iron grains are significantly flattened and radially oriented. Thus, by comparing FIGS. 7 and 7A, it will be seen that the grain shape and orientation is random in FIG. 7, which is a photomicrograph of the piece before extrusion, and are elongated radially of the piece and flattened circumferentially thereof in FIG. 7A, which illustrates the grain structure after two stages of extrusion to bring the outer diameter of the piece from 2.9 in. to 1.25 in. While it is not apparent from FIG. 7A, which is a photomicrograph of a transverse section, the grains are also elongated in the direction of extrusion. Thus, since the grains represent concentrations of maximum strength in the shaped article, flattening and radial orientation of the iron grains establishes in the article strength planes which extend radially and in the extrusion direction.

Figure 4:
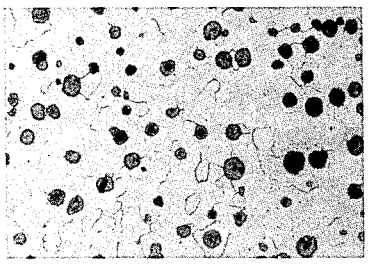
Figure 4A:
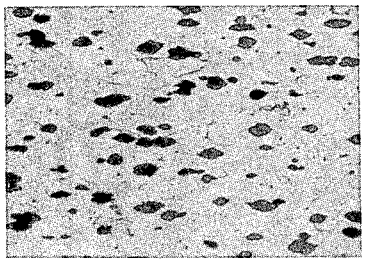
Figure 4B:
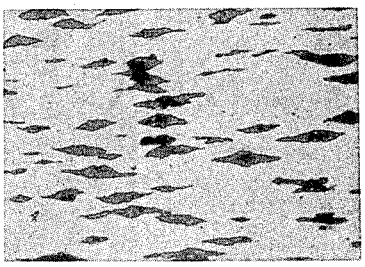
Figure 5:
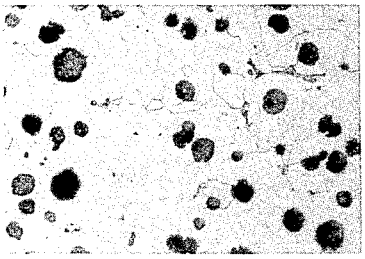
Figure 5A:
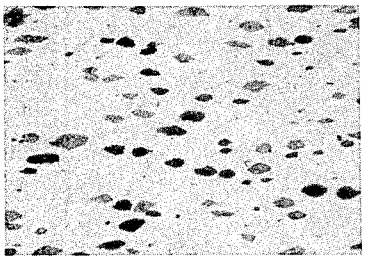
Figure 5B:
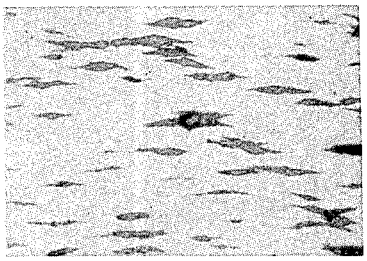
Figure 6:
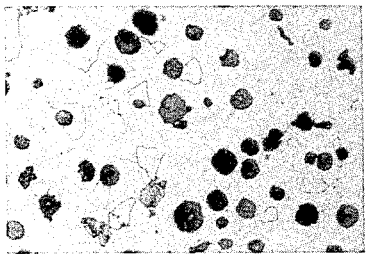
Figure 6A:
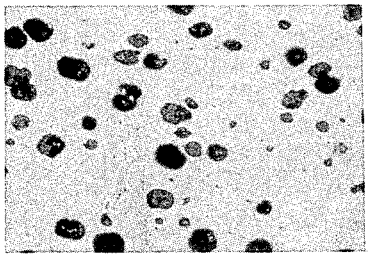
Figure 6B:
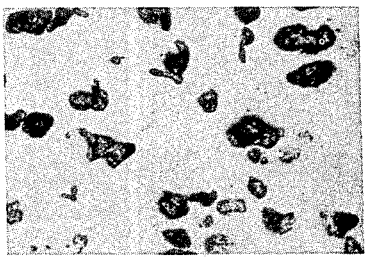
Figure 2C:
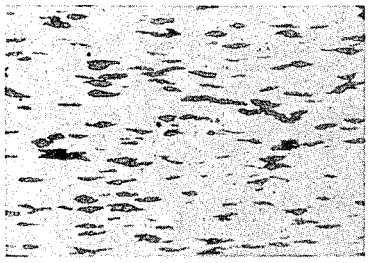
Figure 3C:
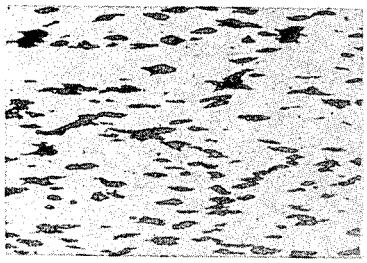
Figure 4C:
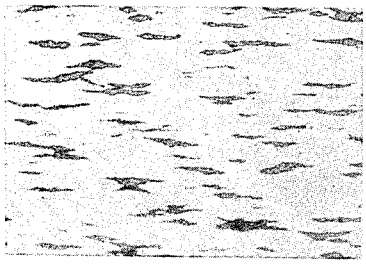
Figure 5C:
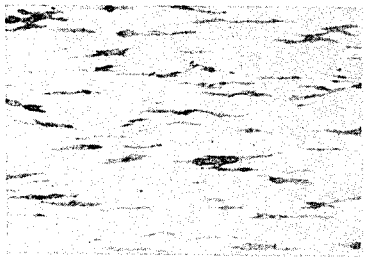
Figure 6C:
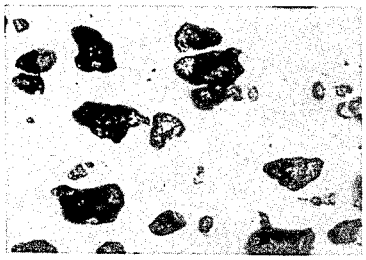

As a result of such flattening and orientation of the iron grains, the initially spheroidal carbon nodules are also flattened and positioned in planes which are radial relative to the extrusion axis and, therefore, relative to the longitudinal axis of the extruded product. Such form and position of the carbon nodules, as a result of practicing the method to achieve an outer diameter reduction from 2.9 in. to 2.0 in., are seen in FIGS. 2A–6A. Comparing the photomicrographs of FIGS. 2 and 2A (and recognizing that only the larger nodules can be dealt with because the photomicrograph is taken on a single plane which cuts approximately near the center of only a few of the nodules), it will be seen that the nodules are elongated to more than 150% in the direction of extrusion near the outer diameter of the extruded piece. Comparing FIG. 5 with FIG. 5A, and FIG. 6 with FIG. 6A, it will be seen that the nodules have been elongated radially of the structure to in excess of 130% of their original dimension. As will be later described, more extensive reduction, by multiple extrusions, causes the nodules to be flattened more extensively, with the thin platelets of FIGS. 2C–6C being typical for a three-step extrusion procedure reducing the diameter of the tubular piece from 2.9 in. to 0.9 in. The most meaningful measure of the extent of flattening of the carbon nodules is the ratio between the average dimension of the nodules in a direction from the inner surface of the annulus toward the outer surface of the annulus to the average thickness at right angles to the plane in which the flattened nodule lies. Considering FIGS. 4A and 5A, for example, that ratio is the average dimension of the flattened nodules vertically on the photomicrograph (and therefore radially of the extruded product) to the average dimension horizontally on the photomicrograph (therefore at right angles to the plane of the flattened nodule). According to the method, the ratio just defined will be at least 1.1:1, and can be as high as 10:1, with the product still exhibiting the normal characteristics of ductile cast iron, i.e., a longitudinal tensile strength of at least 60,000 p.s.i. and an elongation of at least 10% after being stress relieved by heating at 1200°F. for 1 hr. Further, the ratio can be as high as 15:1 without the longitudinal tensile strength falling below 60,000 p.s.i. after stress relieving, though elongations somewhat below 10% may result in that ratio.

Successful extrusion according to the invention requires that the ductile cast iron be confined in hoop compression while in a state of plastic flow. Plastic flow is attained by employing an axial extrusion load, such as is applied by plunger 7, FIG. 1, adequate to bring the pressure on the metal in the die to the compressive yield point, that load then being maintained until the desired extrusion has been accomplished. The compressive yield point is that pressure (expressed in pounds of force per square inch of metal to which the force is applied) which causes the metal to begin to flow with no further increase in pressure.

Figure 8A:
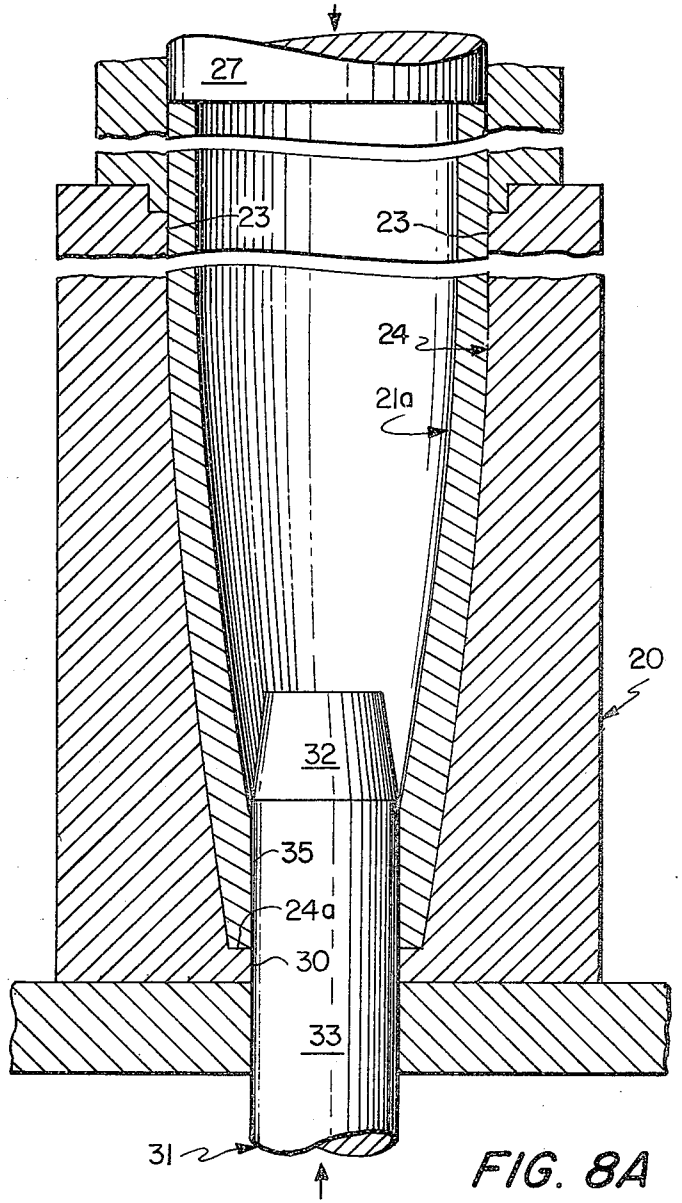
FIGS. 8 and 8A are views similar to FIG. 1 illustrating the method as applied to manufacture of a shell or projectile.
Figure 8:
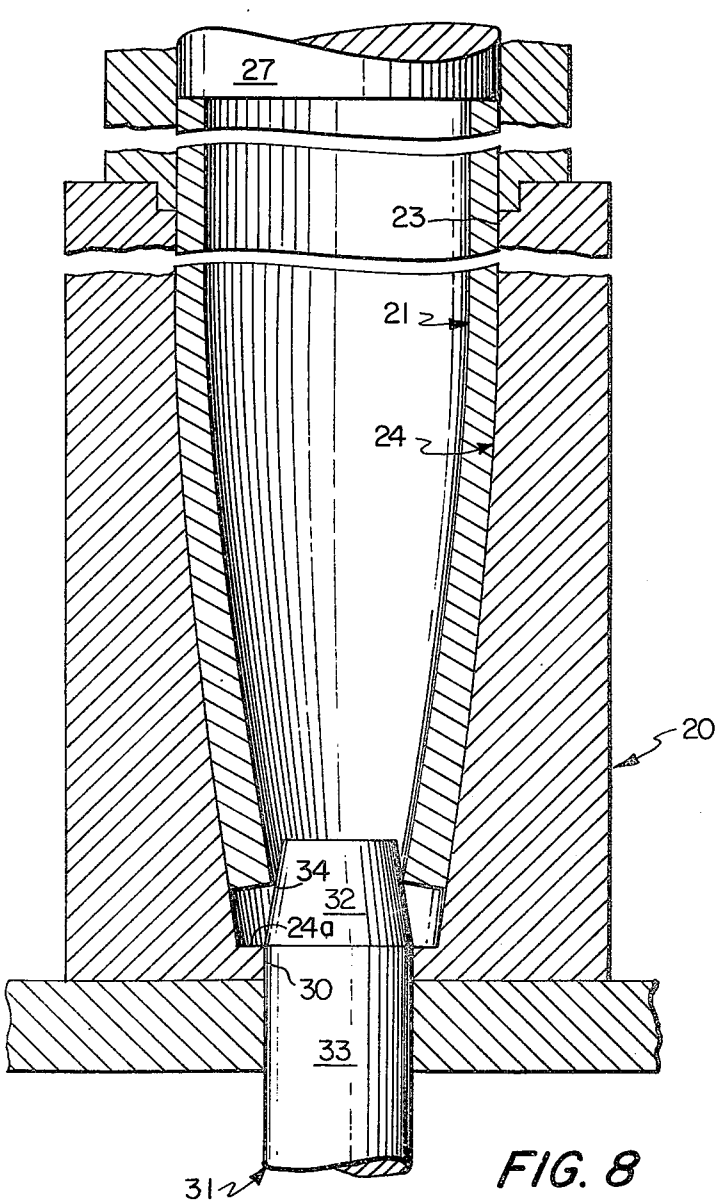

The method can be used to produce articles, such as a simple tube, of reduced transverse cross-section by passing a substantial portion of, or all of, the initial tubular piece completely through the die. However, the method is particularly advantageous for producing articles of more complex configuration, typical examples of such an article being conventional projectiles, rocket warheads, artillery shells, and the like. FIGS. 8 and 8A illustrate the method as employed in the production of such articles. Here, die 20 has an active die surface 24 of the precise external shape desired for the shell 21*a*, FIG. 8A, to be produced. Thus, surface 24 tapers smoothly from an elongated right cylindrical portion 23 to a transverse annular shoulder 24*a* which joins a right cylindrical bore 30 in which a plunger 31 of hardened tool steel is disposed for reciprocating movement axially of the die. Plunger 31 includes an upper nose portion 32 which tapers at a small angle of, e.g., 5°–10°, the remainder 33 of the plunger being right cylindrical. As seen in FIG. 8, press plunger 27 directly engages the end of the initially right cylindrical tubular ductile cast iron piece 21, applying an axial load adequate to force the metal at the leading end of the tubular piece into a state of plastic flow, so that the nose portion of the piece begins to extrude, the wall thickness increasing as the piece proceeds into the die.

Plunger 31 is initially disposed in a downwardly retracted position, e.g., with the juncture between body 33 and nose portion 32 approximately in the plane of shoulder 24*a*. As the extrusion proceeds, the inner peripheral edge 34 of the extrusion comes into engagement with the frusto-conical surface of nose portion 32 of the plunger. Plunger 31 is operated by a suitable power device (not shown) in timed relation with operation of the main press plunger 27 such that upward movement of plunger 31 commences essentially simultaneously with engagement of nose portion 32 by peripheral edge 34. Upward movement of plunger 31 continues as the downward stroke of plunger 27 is completed to finish the extrusion. Thus, the frusto-conical surface of nose portion 32 moves upwardly past the descending end of the extrusion, redirecting the metal adjacent peripheral edge 34 somewhat upwardly. Continued upward movement of plunger 31 causes the right cylindrical surface of body portion 33 to enter the tip of the extrusion, while plunger 27 is still completing the extrusion. As a result, the tip of the extrusion is provided with a right cylindrical surface 35, FIG. 8A, matching the surface of plunger portion 33. The operation is then completed by retraction of plungers 27 and 31 and removal of the completed shell body 21*a* from the die 20. Threads can then be machined on surface 35 to accommodate the usual nose device of the projectile.

Figure 9A:
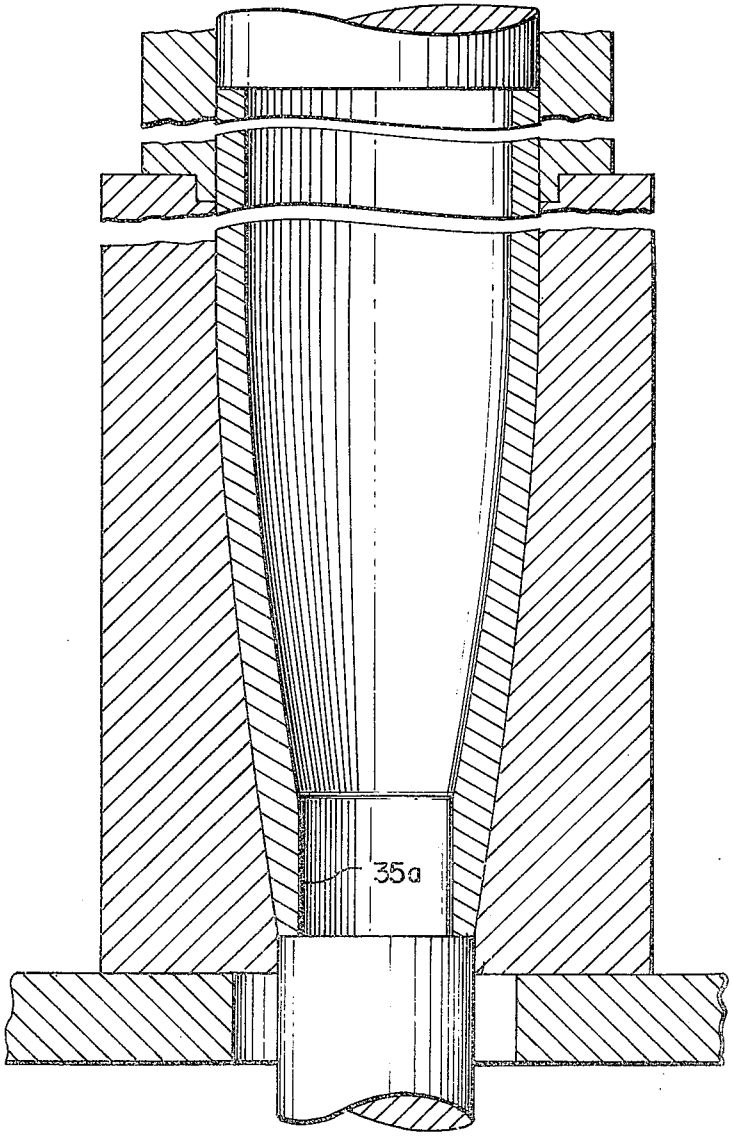
FIGS. 9 and 9A are views similar to FIGS. 8 and 8A but showing an alternative embodiment.
Figure 9:
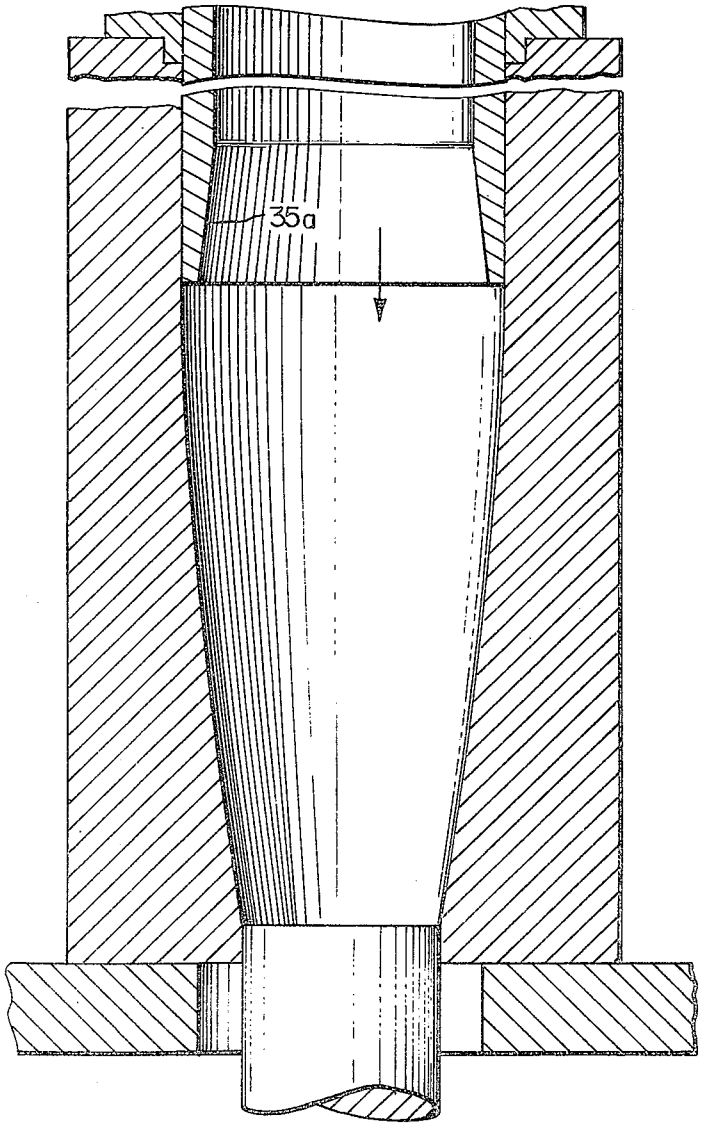

Alternatively, when a cylindrical surface shorter than surface 35, FIG. 8A, is to be provided, or when the wall thickness of the tubular piece is adequate, the plunger 31, FIGS. 8 and 8A, can be dispensed with and the right cylindrical surface provided by machining an inwardly tapering frusto-conical surface 35*a* on the initial tubular piece of ductile cast iron, as shown in FIG. 9, the angle of surface 35*a* being so selected that extrusion of the piece to the final shape will cause surface 35*a*, FIG. 9, to move to the final position seen in FIG. 9A.

In the embodiments illustrated in FIGS. 8–9A, the transverse cross-sectional shape of the initial tubular ductile cast iron piece and of the die are circular. However, the method can be practiced with initial ductile cast iron pieces of circular cross section to produce extruded articles of non-circular transverse cross section. Thus, as shown in FIGS. 10–13 an initial tubular piece of ductile cast iron of circular transverse cross section can be extruded partially or completely into a tubular article of square transverse cross section, using a female die 40 tapering from a circular entrance 41 to a square exit 42, in conjunction with a square mandrel 43. In the simple case illustrated, only a portion of the original piece is extruded, so that the finished article 44, FIG. 13, has an extruded end portion 45 of square transverse cross section, an unextruded end portion 46 of circular cross section and an intermediate portion 47 tapering in transition from circular to square cross section. For this case, mandrel 43 can be of a transverse size such that the annular space between the mandrel and the square exit surface 42 of the die will just accommodate the increased wall thickness of the extruded portion 45 and inward bowing of the walls of portion 45 is thus avoided.

In forming the article 44, the right angles at the corners of the square portion 45 are possible because the metal is confined in compression while in the plastic flow state, just as in the case of the circular extrusions earlier discussed. In this case, however, microscopic examination of the extruded piece show that the flattened carbon nodules are arranged in planes which are always parallel to the extrusion axis and normal to the adjacent outer surface of the article. Thus, the flattened nodules are radial at the rounded corners of the square of portion 45, and at right angles to the respective sides of the square in all other portions of the extruded wall.

While typical examples of annular extruded shapes have been chosen to illustrate the method, it will be apparent that other shapes are possible so long as the tapered shape of the die is such as to confine the metal in hoop compression so long as the metal is in the state of plastic flow.

As extruded, the product exhibits increased tensile strength and hardness, and a reduced elongation, as a result of work to which the metal has been subjected during extrusion. Thus, reduction of a ductile cast iron tube from an outer diameter of 2.9 in. and a wall thickness of 0.15 in. to an outer diameter of 2.0 in. with a wall thickness of 0.2 in. by cold extrusion as described with reference to FIG. 1, with the product having the metalography of FIGS. 2A–6A, results in a typical increase in longitudinal tensile strength from 75,800 p.s.i. to 106,600 p.s.i., an increase in Rockwell B hardness from 85 to 98, and a decrease in elongation from 15.5 to 2.5%. However, the characteristics of the metal can be adjusted readily by heat treatment. Thus, stress relieving the piece just referred to for 1 hour at 1200°F. brought the longitudinal tensile strength to 67,500 p.s.i., the Rockwell B hardness to 70.5 and the elongation to 21.8%, values well within accepted standards for ductile cast iron.

PROVISION OF THE TUBULAR DUCTILE CAST IRON PIECE

Any procedure can be employed to produce the tubular ductile cast iron piece which provides ductile cast iron characterized by containing 1–4.25% by weight carbon, 1–4.25% silicon and not more than 0.20% phosphorous, with the carbon content at least mainly in the form of generally spheroidal nodules dispersed randomly through an essentially ferritic matrix. It is particularly advantageous to employ a tubular piece produced by centrifugal casting against a water cooled steel chill mold, since such a casting is more dense, contains less impurities such as slag and sand, and is free of physical discontinuation, as compared to castings produced by static casting procedures.

The melt for casting can be prepared with any of the usual nodularizing agents, such as magnesium, tellurium, cerium, calcium, lithium, sodium and potassium, though magnesium and combinations of magnesium and cerium are usually employed. The nodularizing agent is introduced in conventional fashion, as by using, e.g., a ferrosilicon-magnesium alloy, a ferrosilicon-magnesium-cerium alloy or a ferrosilicon-nickel-magnesium alloy, or by using coke impregnated with magnesium.

Ignoring carbide stabilizers and additional metals which can be included to improve such characteristics of the final product as hardness, resistance to wear, resistance to heat, the required composition for the tubular ductile iron piece is as follows:

| Ingredient | Range (Percent by Weight) |
|---|---|
| Carbon | 1–4.25 |
| Silicon | 1–4.25 |
| Phosphorous | nil–0.20 |
| Nodularizing agent or agents | 0.02–1.0 |

When the initial tubular piece has a relatively thick wall, e.g., more than ⅛ in., and is produced by centrifugal casting against a steel chill mold, rapid cooling of the iron at the mold surface forms iron carbides to a significant chill depth while the inner portion of the wall of the casting is still molten. The heat from the inner, molten portion of the wall of the casting traverses the chilled portion during dissipation of heat to the mold. When the chilled metal is of sufficient depth and the iron carbide content thereof is sufficiently unstable, transfer of heat from the still-liquid metal through the chilled section causes an inner portion of the chilled section to anneal, with resultant precipitation of carbon as free graphite, with the result that the metal at the inner portion of the chilled section increases in volume, causing internal stresses which overcome the tensile strength of the outer portion of the chilled section, which is not annealed. As a result, the outer portion fails, exhibiting cracks to a considerable depth and making the tubular piece unsuitable for cold extrusion according to the invention. It is highly advantageous to prevent such damage from self-annealing by including in the melt at least one carbide stabilizer. Chromium is a particularly effective carbide stabilizer but is characterized by forming carbides which are unusually strong and can result in marked increases in the required annealing times. Carbide stabilizers which are milder in their action include manganese, nickel, copper and molybdenum. When chromium is employed as a carbide stabilizer, it should not exceed 0.15% by weight. Considering only the carbide stabilizing effect, manganese can be included in amounts up to 1% by weight, nickel used up to 0.3%, copper can be used in amounts up to 0.3%, and molybdenum up to 0.3%, with the required annealing time for the tubular piece being 1–3 hours. To achieve tubular pieces of superior quality with annealing times on the order of 1–3 hours, it is advantageous to employ combinations of the carbide stabilizers mentioned above, with a total of 0.6% being adequate when a significant amount of chromium is included, and a total of 1.0% being adequate when chromium is omitted.

When the finished article is to have increased resistance to wear and heat and increased hardness, the proportion of nickel can be increased to as much as 35%, the amount of copper can be increased to as much as 35%, manganese to as much as 1%, and molybdenum can be increased to 1%. It will be understood that the combined amounts of nickel and copper, when both ae used, will not exceed 35%.

Advantageously, stock for use according to the invention is made from 100% selected steel scrap melted in a basic-to-neutral operated cupola, or in an electric furnace, and innoculated in the ladle to bring the composition of the treated iron within the following ranges:

| Ingredient | Range (Percent by Weight) |
|---|---|
| Silicon | 1.00–4.25 |
| Manganese | .30–1.00 |
| Nickel and/or Copper[1/] | .03–35.00 |
| Chromium | nil –.15 |
| Magnesium | .02–.10 |
| Molybdenum | nil–1.00 |
| Phosphorous | .05–.20 |
| Total carbon | 1.00–4.25 |

-continued

| Ingredient | Range (Percent by Weight) |
|---|---|
| Sulfur | nil–.01 |

[1/]Nickel and copper are interchangeable, one can be used up to 35%, or both can be included with the combined amounts of nickel and copper not exceeding 35%.

Particularly advantageous formulations, yielding centrifugally cast tubular pieces which can be adequately annealed in 1–3 hours, are as follows:

| Ingredient | Range (Percent by Weight) |
|---|---|
| Silicon | 2.50–3.25 |
| Manganese[1/] | .30–.60 |
| Nickel and/or copper[1/] | .30–.20 |
| Chromium[1/] | .05–.10 |
| Magnesium | .02–.04 |
| Molybdenum[1/] | nil–.20 |
| Phosphorous | nil–.15 |
| Total carbon | 3.50–3.80 |
| Sulfur | nil–.01 |

[1/]Total not to exceed 0.6%

The casting is annealed, typically for a first period of time at 1650°–1850°F., to eliminate iron carbide, and a second period at 1350°–1450°F. to eliminate pearlite, the total time depending upon the proportions of carbide stabilizers and alloying metals present. For the preferred formulations, typical overall annealing cycles are 1–3 hours, evenly divided between the two temperatures. After annealing, the outer and inner surfaces are machined to produce a smooth uninterrupted surface of ductile cast iron.

Success of cold extrusion according to the invention depends upon presence of an essentially ferritic matrix through which the carbon nodules are distributed. That is, the matrix must be essentially free from iron carbides and contain pearlite in an amount not more than 15% of the area, as determined by viewing the area microscopically.

The method offers greatest advantages when the cold extrusion step is carried out to reduce the outer transverse dimension by not more than 50% and increase the wall thickness by not more than 60% of the maximum transverse dimension, with that reduction being accomplished in a single extrusion. Within those limitations, a single extrusion yields a product which, when stress relieved, retains the longitudinal tensile, elongation and hardness characteristics specified for ductile cast iron. Once an extrusion has been carried out according to the invention, the extruded product can be stress relieved and again extruded, and assuming reductions of 30–35% for the first extrusion and not more than 40% for the second extrusion step, the finished product, when stress relieved, still retains at least the minimum longitudinal tensile, elongation and hardness characteristics of ductile cast iron.

The following example is typical of the method, and the articles produced are exemplary of the product embodiments:

EXAMPLE 1

Using conventional practices, ductile iron was prepared by melting automotive, plate and structural scrap steel in a basic-to-neutral operated cupola and the melt treated with a standard nodularizing alloy of ferrosilicon-magnesium-cerium containing 5% magnesium and 0.5% cerium to produce treated iron with the following analysis:

| Ingredient | Percent by Weight |
|---|---|
| Silicon | 3.07 |
| Manganese | .34 |
| Nickel | .09 |
| Chromium | .08 |
| Magnesium | .056 |
| Copper | .17 |
| Phosphorous | .08 |
| Total carbon | 3.42 |
| Sulfur | .008 |

The metal was cast in a water-cooled, steel mold, centrifugal casting machine into pipe of 3 in. nominal outer diameter. The cast pipe was annealed at 1800°F. for 20 min., reduced over 20 min. to 1450°F. and held at that temperature for 20 min. After annealing, the carbon content of the pipe was mainly in the form of generally spherical nodules randomly dispersed through an essentially ferritic matrix, such metal being illustrated in the photomicrograph in FIG. 7. The pipe exhibited an axial tensile strength of 75,800 p.s.i., an elongation of 15.5%, and a Rockwell B hardness of 85.0.

The inner and outer surfaces of the pipe were then machined to assure that both surfaces would be continuous smooth surfaces of ductile cast iron and to bring the outer diameter to 2.9 in. and the wall thickness to 0.15 in. Without further preparation, the pipe was sprayed with a conventional molybdenum disulfide solid film lubricant (MOLYKOTE G, marketed by The Alpha-Molykote Corp., Stamford, Connecticut).

Using apparatus as illustrated in FIG. 1, the pipe was passed through three stages of extrusion, first with a die angle of 16° to decrease the outer diameter to 2.0 in., then with a die angle of 8.5° to reduce the outer diameter to 1.25 in., and finally with a die angle of 7.5° to reduce the outer diameter to 0.9 in., the extruded product being stress relieved for 1 hr. at 1200°F. between the first and second extrusions and between the second and third extrusions. The molybdenum disulfide lubricant was sprayed onto the tube again before the second and third extrusions. Conditions during the first stage of extrusion were as follows:

| Length of Extrusion (inches) | Extrusion Load (pounds) |
|---|---|
| .5 | 26,000 |
| 1.0 | 50,000 |
| 1.5 | 74,000 |
| 2.0 | 89,000 |
| 2.5 | 102,000 |
| 3.0 | 107,000 |
| 3.5 | 111,000 |
| 4.0 | 115,000 |
| 4.5 | 120,000 |
| 5.0 | 123,000 |
| 5.5 | 123,000 |
| 6.0 | 122,000 |
| 6.5 | 121,000 |
| 7.0 | 120,000 |

The length of the tubular piece increased from 7.35 in. to 8.25 in. and the wall thickness increased from 0.15 in. to 0.22 in. Before being stress relieved, the axial tensile strength of the extruded product was 106,600 p.s.i., elongation was 2.5%, and Rockwell B hardness was 98.0. After stress relieving, axial tensile strength was 67,500 p.s.i., elongation 21,.8%, and Rockwell B hardness 70.5. The extruded product was completely free from evidence of structural failure and the outer surface thereof was improved in the sense that it had a smoother appearance as if burnished so that, for most purposes, additional machining is unnecessary. The carbon nodules were flattened and oriented in planes which are radial to the extrusion line, the photomicrographs of FIGS. 2A–6A being of this extruded product.

The outer surface of the extruded piece was machined only to remove the oxide coating resulting from stress relieving (a precaution because the extrusion die employed was of unhardened tool steel), and the inner surface was machined to reduce the wall thickness of 0.1 in. and thus avoid occurrence of an unduly large wall thickness on further extension. Conditions during the second extrusion were as follows:

| Length of Extrusion (inches) | Extrusion Load (pounds) |
|---|---|
| 0.5 | 7,500 |
| 1.0 | 13,000 |
| 1.5 | 19,000 |
| 2.0 | 24,000 |
| 2.5 | 31,000 |
| 3.0 | 38,000 |
| 3.5 | 43,000 |
| 4.0 | 45,000 |
| 4.5 | 46,000 |
| 5.0 | 46,000 |
| 5.5 | 46,500 |
| 6.0 | 46,000 |
| 6.5 | 45,500 |
| 7.0 | 46,000 |
| 7.5 | 46,000 |
| 8.0 | 47,000 |
| 8.5 | 47,000 |
| 9.0 | 47,000 |
| 9.5 | 47,000 |

The length of the tubular piece increased from 8.06 in. to 10.5 in. and the wall thickness increased from 0.1 in. to 0.168 in. Before being stress relieved, the extruded product exhibited a tensile strength of 109,200 p.s.i., an elongation of 1.1% and a Rockwell B hardness of 95.0. After stress relieving, the tensile strength was 64,500 p.s.i., the elongation 13.2%, and the Rockwell B hardness 67.0. The extruded product was again completely free of evidence of structural failure and presented an outer surface requiring no additional machining for most purposes. The carbon nodules were still further flattened, having elongated to approximately 200% of their original (virgin metal) size, the photomicrographs of FIGS. 2B–6B being of this extruded product.

Again to remove oxide coating and avoid an unduly large wall thickness in the extruded product, the product of the second extrusion was machined as before to a wall thickness of 0.1 in. Conditions during the third extrusion were as follows:

| Length of Extrusion (inches) | Extrusion Load (pounds) |
|---|---|
| 0.5 | 7,500 |
| 1.0 | 14,000 |
| 1.5 | 17,500 |
| 2.0 | 19,500 |
| 2.5 | 18,500 |
| 3.0 | 19,000 |
| 3.5 | 20,000 |
| 4.0 | 21,500 |
| 4.5 | 23,500 |
| 5.0 | 27,000 |
| 5.5 | 30,000 |
| 6.0 | 27,500 |
| 6.5 | 24,500 |

-continued

| Length of Extrusion (inches) | Extrusion Load (pounds) |
|---|---|
| 7.0 | 24,500 |

The length of the extruded piece increased from 6.875 in. to 8.06 in. and the wall thickness from 0.1 in. to 0.133 in. Before being stress relieved, the extruded product exhibited a longitudinal tensile strength of 100,400 p.s.i., an elongation of 1.5% and a Rockwell B hardness of 72.0. After stress relieving, the tensile strength was 64,700 p.s.i., the elongation 8.7% and the Rockwell B hardness 58.0.

In order to perform burst tests, the extrusions were repeated identically and burst test rings cut and machined to known diameters and wall thicknesses from each extrusion. The rings were subjected to internal hydrostatic pressure, without being subjected to a clamping force, until the ring burst. Circumferential tensile strength was computed for each test ring, with the results as follows:

| Extrusion | Outside Dia. of Ring (In.) | Wall Thickness of Ring (In.) | Burst Pressure[1] Before Stress Relieving | Burst Pressure[1] After Stress Relieving | Circumferential Tensile Strength[2] Before Stress Relieving | Circumferential Tensile Strength[2] After Stress Relieving |
|---|---|---|---|---|---|---|
| 1 | 1.962 | .1525 | 12,000 | | 77,193 | |
| 1 | 1.965 | .1145 | 11,500 | | 98,679 | |
| 1 | 1.956 | .1150 | | 8,000 | | 68,035 |
| 1 | 1.965 | .1110 | | 8,000 | | 70,810 |
| 2 | 1.269 | .1270 | 13,500 | | 67,447 | |
| 2 | 1.259 | .1410 | 16,000 | | 71,433 | |
| 2 | 1.259 | .1340 | | 13,000 | | 61,071 |
| 2 | 1.250 | .1450 | | 14,000 | | 60,345 |
| 3 | .923 | .1125 | 10,400 | | 42,663 | |
| 3 | .912 | .0750 | 7,300 | | 44,383 | |
| 3 | .930 | .0810 | | 6,000 | | 34,875 |
| 3 | .931 | .1095 | | 8,000 | | 34,009 |

[1]Lbs. per sq. in. of hydraulic pressure
[2]Ultimate tensile strength of the material in lbs. per sq. in.

The results of the burst tests show that, though flattening and radial orientation of the carbon nodules and iron grains causes a marked reduction in circumferential tensile strength, the burst pressures exhibited by even the third extrusion were adequate for commercial use, even though the third extrusion represents an overall reduction of the outer diameter from 2.9 in. to 0.9 in., i.e., 60%. Further, the products resulting from the first two extrusions exhibited tensile strengths above the minimum standard for ductile cast iron, even in the circumferential direction.

CHARACTERIZATION OF THE PRODUCTS

Products resulting from the method are annular ductile iron pieces at least an axial portion of which is characterized by having the carbon content thereof in the form of significantly flattened bodies which are predominantly disposed in planes which are parallel to the central axis of the piece and normal to the outer surface of the piece along the line of intersection of the plane and outer surface, and also characterized by having the iron grains significantly extended both in a direction parallel to the axis of the piece and in directions which are transverse to the axis and parallel to said planes. Advantageously, the ratio of the dimension of the flattened carbon bodies in a direction from the inner surface to the outer surface of the article to the average thickness of the flattened bodies is at least 1.1:1, and that ratio can be as high as 10:1 with the article still having the minimum tensile, hardness and elongation characteristics of ductile cast iron, and as high as 15:1 with the article still having a longitudinal tensile strength of at least 60,000 p.s.i. The shape and orientation of the carbon bodies is uniquely characteristic of products according to the invention, as is also the fact that the circumferential tensile strength of the extruded article or portion is significantly lower than the longitudinal tensile strength.

From the standpoint of composition, the products contain 1–4.25% carbon, the carbon content being at least mainly in the form of flattened and oriented bodies in the extruded portion of the article, if the article be a partially extruded product such as those shown in FIGS. 8A and 13, or in the entire article if the entire article be extruded. The carbon content is distributed through an essentially ferritic matrix which is free of iron carbides and in which any perlite content is minimized, though as much as 10% pearlite can be present. Phosphorous, if significantly present, is kept to a portion not exceeding 0.20%.

The articles can be of curvilinear transverse cross section, as is the case with those shown in FIGS. 1, 8A and 9A, or can have a portion which is of polygonal transverse cross section, as is true for that shown in FIG. 13. Alternatively, the entire article can be of physical transverse cross section.

The articles can be characterized by tensile strengths and hardnesses which are high as compared with those of conventional ductile cast iron, or can have strengths, hardnesses and elongations in the normal ranges for ductile cast iron. Thus, if the article be not stress relieved, longitudinal tensile strengths will ordinarily be in excess of 100,000 p.s.i. and Rockwell B hardnesses in excess of 90, save in cases of extreme reduction in cross section. However, stress relieving for 1 hr. at 1200°F. will reduce the tensile strength and hardness and correspondingly increase elongation.

The outer surfaces of the extruded articles, or of the extruded portions thereof, are smooth, uninterrupted ductile iron surfaces which, under normal circumstances in the trade, require no machining.

DEFINITIONS

1. "Longitudinal tensile strength" is the tensile stress under which an elongated sample cut lengthwise of the wall of the extruded product fails, and is expressed in pounds per square inch of the transverse cross section of the sample. Since the wall thickness of the extruded article may be relatively small, a sample blank is cut from the wall as an elongated rectangular piece, long dimension parallel to the longitudinal axis of the article. Such a sample blank is transversely arcuate in the case of an article of circular transverse cross section. Accordingly, a central portion of the sample blank is machined to the form of a right cylinder of a diameter essentially equal to the wall thickness of the article, leaving two enlarged transversely arcuate end portions which are not suitable to be engaged in the usual tensile test machines because their arcuate nature would cause the sample to be subjected to a bending moment in addition to tensile stress. The side edges of the transversely arcuate end portions are therefore provided with screw thread segments and a nut is applied to each end portion to complete the blank for test.

2. "Circumferential tensile strength" is that tensile stress applied circumferentially to a portion of the article which will cause the wall of the test portion to rupture. The test is carried out by cutting the article transversely to provide the ring, machining the ring to known inner and outer diameters and thereby providing a known wall thickness, and subjecting the ring to an increasing internal hydrostatic force, without subjecting the ring to a clamping force, until the ring bursts. The circumferential tensile strength is then computed in pounds per square inch according to the following formula:

$$\text{Circumferential Tensile Strength} = \frac{\text{Burst pressure (p.s.i.)} \times \text{O.D. (in.)}}{2 \times \text{Wall thickness (in.)}}$$

3. "Ductile cast iron" is cast iron which, by reason of containing carbon in the form of generally spheroidal nodules, exhibits a considerably greater elongation than does grey cast iron.

4. "Ductile iron" is employed herein as generic to ductile cast iron and iron which exhibits a considerably greater elongation than does grey cast iron but which does not contain carbon in the form of nodules which are of generally spheroidal shape.

5. "Cold extrusion" is extrusion without addition of external heat.

6. An "essentially ferritic matrix" is an iron matrix which is essentially free of iron carbides and contains nil to 15% pearlite (on the basis of total area as viewed microscopically).

What is claimed is:

1. The method for producing an annular iron article, comprising:

providing a tubular piece of ductile cast iron containing

1–4.25% carbon,

1–4.25% silicon,

0–0.20% phosphorous, and at least one nodularizing agent, the iron being in the form of an essentially ferritic matrix, and the free carbon being mainly in the form of nodules distributed through the matrix; and cold extruding at least an axial portion of said tubular piece through a tapered female die by applying axial pressure to the piece until the compressive yield point of the ductile cast iron is reached and the metal is caused to traverse the die in plastic flow while maintained under hoop compression, whereby said carbon nodules are flattened and arranged in planes which are parallel to the axis of extrusion, and the grain structure of the iron is extended in the direction of extrusion and in directions parallel to said planes.

2. The method according to claim 1, wherein said step of cold extruding said piece is carried out to accomplish not more than a 50% reduction in the maximum transverse dimension and an increase in wall thickness not exceeding 60%; and the finished product, after stress relieving, exhibits a longitudinal tensile strength of at least 60,000 p.s.i. and an elongation of at least 10%.

3. The method according to claim 1, wherein said tubular piece is of circular transverse cross section and the extruded product is of circular transverse cross section.

4. The method according to claim 1, wherein said tubular piece is of circular transverse cross section and only an axial portion thereof is extruded into curvilinearly tapered configuration.

5. The method according to claim 1, wherein said tubular piece is provided by centrifugal chill casting.

6. The method according to claim 1, wherein said step of cold extruding is carried out in a plurality of successive stages; and the extruded product from each stage is stress relieved before the next successive stage.

7. The method according to claim 1, wherein said tubular piece is of curvilinear transverse cross section; only a portion of said tubular piece is extruded; and the extruded portion is of polygonal transverse cross section.

8. The method according to claim 1, wherein the extruded product is of polygonal transverse cross section.

9. The method according to claim 1, wherein said tubular piece of ductile cast iron contains 3.5–3.8% carbon, and 2.5–3.25% silicon.

10. The method according to claim 9, wherein said tubular piece of ductile cast iron is made by centrifugal casting against a water-cooled chill mold, the cast iron of said tubular piece containing at least one carbide stabilizer selected from the group consisting of chromium, manganese, nickel, copper and molybdenum.

11. The method according to claim 10, wherein said tubular piece of ductile cast iron contains chromium in an amount not exceeding 0.15% by weight.

12. The method according to claim 10, wherein said tubular piece of ductile cast iron contains chromium and at least on other carbide stabilizer selected from said group and the total proportion of carbide stabilizers employed does not exceed 0.6% weight.

13. The method according to claim 10, wherein said tubular piece of ductile cast iron contains a plurality of carbide stabilizers selected from said group but excluding chromium and the total proportion of said carbide stabilizers does not exceed 1% by weight.

14. The method according to claim 1, wherein said carbon nodules are flattened to bring the ratio of the average dimension thereof in a direction from the inner surface to the outer surface of the article to the average thickness thereof at right angles to the plane in which the body is disposed to at least 1.1.

15. The method according to claim 14, wherein said ratio is not more than 15, and the extruded article, after being stress relieved, has a longitudinal tensile strength of at least 60,000 p.s.i. and a significantly lower tensile strength circumferentially of the article.

16. The method for producing an annular iron article, comprising:

providing a tubular piece of ductile cast iron containing 1–4.25% carbon and 1–4.25% silicon, the iron of the ductile cast iron being in the form of an essentially ferritic matrix and the free carbon of the ductile cast iron being in the form of generally spheroidal nodules distributed through the ferritic matrix;

subjecting said piece while cold to axial pressure while annularly confining the piece to bring the iron matrix of one end of said piece to a state of plastic flow; and causing the metal which is in the state of plastic flow to flow into the shape desired under the influence of said pressure with said step of annularly confining the piece being effective to maintain that metal under hoop compression, said plastic flow while under hoop compression causing said nodules to be flattened and oriented radially with respect to the axis of said hoop compression.

* * * * *